US007284533B1

(12) United States Patent
Huang et al.

(10) Patent No.: US 7,284,533 B1
(45) Date of Patent: Oct. 23, 2007

(54) METHOD OF OPERATING AN ENGINE BRAKE

(75) Inventors: Shengqiang Huang, West Simsbury, CT (US); Zhou Yang, Oak Ridge, NC (US); John A. Schwoerer, Storrs, CT (US)

(73) Assignee: Jacobs Vehicle Systems, Inc, Bloomfield, CT (US)

( * ) Notice: Subject to any disclaimer, the term of this patent is extended or adjusted under 35 U.S.C. 154(b) by 0 days.

(21) Appl. No.: 11/429,225

(22) Filed: May 8, 2006

(51) Int. Cl.
*F02D 13/04* (2006.01)

(52) U.S. Cl. ..... 123/321

(58) Field of Classification Search ..... 123/320, 123/321, 322
See application file for complete search history.

(56) References Cited

U.S. PATENT DOCUMENTS 6,152,104 A * 11/2000 Vorih et al. ..... 123/322
6,925,976 B2 * 8/2005 Israel et al. ..... 123/321
2006/0081213 A1 * 4/2006 Yang et al. ..... 123/321

* cited by examiner

*Primary Examiner*—Erick Solis
(74) *Attorney, Agent, or Firm*—David R. Yohannan; Kelley Drye & Warren LLP

(57) ABSTRACT

Methods and apparatus for actuating an engine valve provided between an engine cylinder and an exhaust manifold to provide compression-release engine braking in combination with exhaust gas restriction and brake gas recirculation are disclosed. In a first embodiment of the present invention, the engine valve used to provide brake gas recirculation and compression-release braking may be maintained slightly open between the brake gas recirculation and compression-release events. In another embodiment of the present invention, the cam closing ramp for a main exhaust event may be extended to terminate near the beginning of a brake gas recirculation event to facilitate refilling a hydraulic valve actuation system used to in association with the exhaust valve.

18 Claims, 4 Drawing Sheets

METHOD OF OPERATING AN ENGINE BRAKE

FIELD OF THE INVENTION

The present invention relates generally to a method for operating an engine brake in internal combustion engines.

BACKGROUND OF THE INVENTION

In an internal combustion engine, engine valve actuation is required in order to produce positive power, and may also be used to produce engine braking and/or exhaust gas recirculation (EGR). During positive power, one or more intake valves may be opened to admit air into a cylinder for combustion during the intake stroke of the piston. One or more exhaust valves may be opened to allow combustion gases to escape from the cylinder during the exhaust stroke of the piston.

One or more exhaust valves may also be selectively opened to convert, at least temporarily, the engine into an air compressor for engine braking operation. This air compressor effect may be accomplished by either opening one or more exhaust valves near piston top dead center (TDC) position for compression-release type braking, or by maintaining one or more exhaust valves in a relatively constant cracked open position during much or all of the piston motion, for bleeder type braking. In either of these methods, the engine may develop a retarding force that may be used to help slow a vehicle down. This braking force may provide the operator with increased control over the vehicle, and may also substantially reduce the wear on the service brakes. Compression-release type engine braking has been long known and is disclosed in Cummins, U.S. Pat. No. 3,220,392 (November 1965), which is hereby incorporated by reference.

The braking power of a compression-release type engine brake may be increased by selectively actuating the exhaust valves to carry out brake gas recirculation in combination with compression release braking. Brake gas recirculation (BGR) can be accomplished by opening an exhaust or auxiliary valve near bottom dead center of the intake or expansion stroke of the piston and keeping the exhaust or auxiliary valve open during the first portion of the exhaust or compression stroke of the engine. Opening the exhaust or auxiliary valve during this portion of the engine cycle may allow exhaust gas to flow into the engine cylinder from the relatively higher-pressure exhaust manifold. The introduction of exhaust gases from the exhaust manifold into the cylinder may pressurize the cylinder with a charge faster than it would otherwise occur during the compression stroke. The increased gas pressure in the engine cylinder may increase the braking power produced by the compression-release event.

There are many different systems that may be used to selectively actuate an exhaust or auxiliary valve to produce BGR and compression-release events. One known type of actuation system is a lost motion system, described in the aforenoted Cummins patent. An example of a lost motion system and method used to obtain engine braking and brake gas recirculation is disclosed in Gobert, U.S. Pat. No. 5,146,890 (Sep. 15, 1992) which discloses a method of conducting brake gas recirculation by placing the cylinder in communication with the exhaust system during the first part of the compression stroke and optionally also during the latter part of the intake stroke, and which is hereby incorporated by reference. Gobert uses a lost motion system to enable and disable compression-release braking and brake gas recirculation. The system disclosed in Gobert opens the exhaust valve near bottom dead center of the intake stroke for a BGR event, closes the exhaust valve before the midway point of the compression stroke to terminate the BGR event, and opens the exhaust valve again near top dead center of the same compression stroke for a compression-release event. As a result, the exhaust valve actuated in accordance with the Gobert system must be rapidly seated and unseated between the BGR and compression-release events.

In many internal combustion engines, the intake and exhaust valves may be actuated by fixed profile cams, and more specifically, by one or more fixed lobes or bumps that are an integral part of each cam. The cams may include a lobe for each valve event that the cam is responsible for providing. The size and shape of the lobes on the cam may dictate the valve lift and duration which result from the lobe. For example, an exhaust cam profile for a system constructed in accordance with the aforenoted Gobert patent may include a lobe for a BGR event, a lobe for a compression-release event, and a lobe for a main exhaust event.

It may also be desirable to increase the exhaust back pressure in the exhaust manifold during engine braking. Higher exhaust back pressure may increase gas mass and pressure in the engine cylinder available for engine braking, and thereby increase braking power. Increased exhaust back pressure, however, may undesirably increase the force required to open the exhaust valve for a compression-release event because the opening force applied to the exhaust valve must exceed the increased pressure in the engine cylinder resulting from the increased exhaust back pressure. To some extent the increased exhaust back pressure may also increase the pressure applied to the back of the exhaust valve, which may counter-balance the increased pressure in the cylinder and thus reduce the loading on the exhaust valve opening mechanism used for the compression-release event.

Increasing the pressure of gases in the exhaust manifold may be accomplished by restricting the flow of gases through the exhaust manifold. Exhaust manifold restriction may be accomplished through the use of any structure that may, upon actuation, restrict all or partially all of the flow of exhaust gases through the exhaust manifold. The exhaust restrictor may be in the form of an exhaust engine brake, a turbocharger, a variable geometry turbocharger, a variable geometry turbocharger with a variable nozzle turbine, and/or any other device which may limit the flow of exhaust gases.

Exhaust brakes generally provide restriction by closing off all or part of the exhaust manifold, thereby preventing the exhaust gases from escaping. This restriction of the exhaust gases may provide a braking effect on the engine by providing a back pressure when each cylinder is on the exhaust stroke. For example, Meneely, U.S. Pat. No. 4,848,289 (Jul. 18, 1989); Schaefer, U.S. Pat. No. 6,109,027 (Aug. 29, 2000); Israel, U.S. Pat. No. 6,170,474 (Jan. 9, 2001); Kinerson et al., U.S. Pat. No. 6,179,096 (Jan. 30, 2001); and Anderson et al., U.S. Pat. Appl. Pub. No. US 2003/0019470 (Jan. 30, 2003) disclose exhaust brakes for use in retarding engines.

Turbochargers may similarly restrict exhaust gas flow from the exhaust manifold. Turbochargers often use the flow of high pressure exhaust gases from the exhaust manifold to power a turbine. A variable geometry turbocharger (VGT) may alter the amount of the high pressure exhaust gases that it captures in order to drive a turbine. For example, Arnold et al., U.S. Pat. No. 6,269,642 (Aug. 7, 2001) discloses a variable geometry turbocharger where the amount of exhaust gas restricted is varied by modifying the angle and the length of the vanes in a turbine. An example of the use of a variable geometry turbocharger in connection with engine braking is disclosed in Faletti et al., U.S. Pat. No. 5,813,231 (Sep. 29, 1998), Faletti et al., U.S. Pat. No. 6,148,793 (Nov. 21, 2000), and Ruggiero et al., U.S. Pat. No. 6,866,017 (Mar. 15, 2005), which are hereby incorporated by reference.

Compression-release engine braking is not the only type of engine braking known. The operation of a bleeder type engine brake has also long been known. During bleeder type engine braking, in addition to the normal exhaust valve lift, the exhaust valve(s) may be held slightly open continuously throughout the remaining engine cycle (full-cycle bleeder brake) or during a portion of the cycle (partial-cycle bleeder brake). The primary difference between a partial-cycle bleeder brake and a full-cycle bleeder brake is that the exhaust valve is closed for the former during most of the intake stroke.

Usually, the initial opening of the braking valve(s) in a bleeder braking operation is far in advance of the compression TDC (i.e., early valve actuation) and then lift is held constant for a period of time. As such, a bleeder type engine brake may require much lower force to actuate the valve(s) due to early valve actuation, and generates less noise due to continuous bleeding instead of the rapid blow-down of a compression-release type brake. Moreover, bleeder brakes often require fewer components and can be manufactured at lower cost. Thus, an engine bleeder brake can have significant advantages.

BRIEF SUMMARY OF THE INVENTION

One embodiment of the present invention is directed to an innovative method of actuating an engine valve provided between an engine cylinder and an exhaust manifold to provide compression-release engine braking comprising the steps of: opening the engine valve for a brake gas recirculation event; increasing the lift of the engine valve during an initial portion of the brake gas recirculation event; reducing the lift of the engine valve during a later portion of the brake gas recirculation event; maintaining the engine valve open between the brake gas recirculation event and a compression-release event; and increasing the lift of the engine valve during an initial portion of the compression-release event.

Another embodiment of the present invention is directed to an innovative internal combustion engine cam for compression-release engine braking comprising: a main exhaust lobe including an extended closing ramp portion; a brake gas recirculation lobe; a compression-release lobe; and a base circle portion extending approximately 15 cam angle degrees or less between the main exhaust lobe extended closing ramp portion and the brake gas recirculation lobe.

Yet another embodiment of the present invention is directed to an innovative internal combustion engine cam for compression-release engine braking comprising: a base circle portion; a brake gas recirculation lobe; a compression-release lobe; and a depressed region between the brake gas recirculation lobe and the compression-release lobe, wherein said depressed region has a height greater than the base circle portion of the cam.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

The present invention will now be described in connection with the following figures in which like reference numbers refer to like elements and wherein.

DETAILED DESCRIPTION OF THE INVENTION

Figure 1:
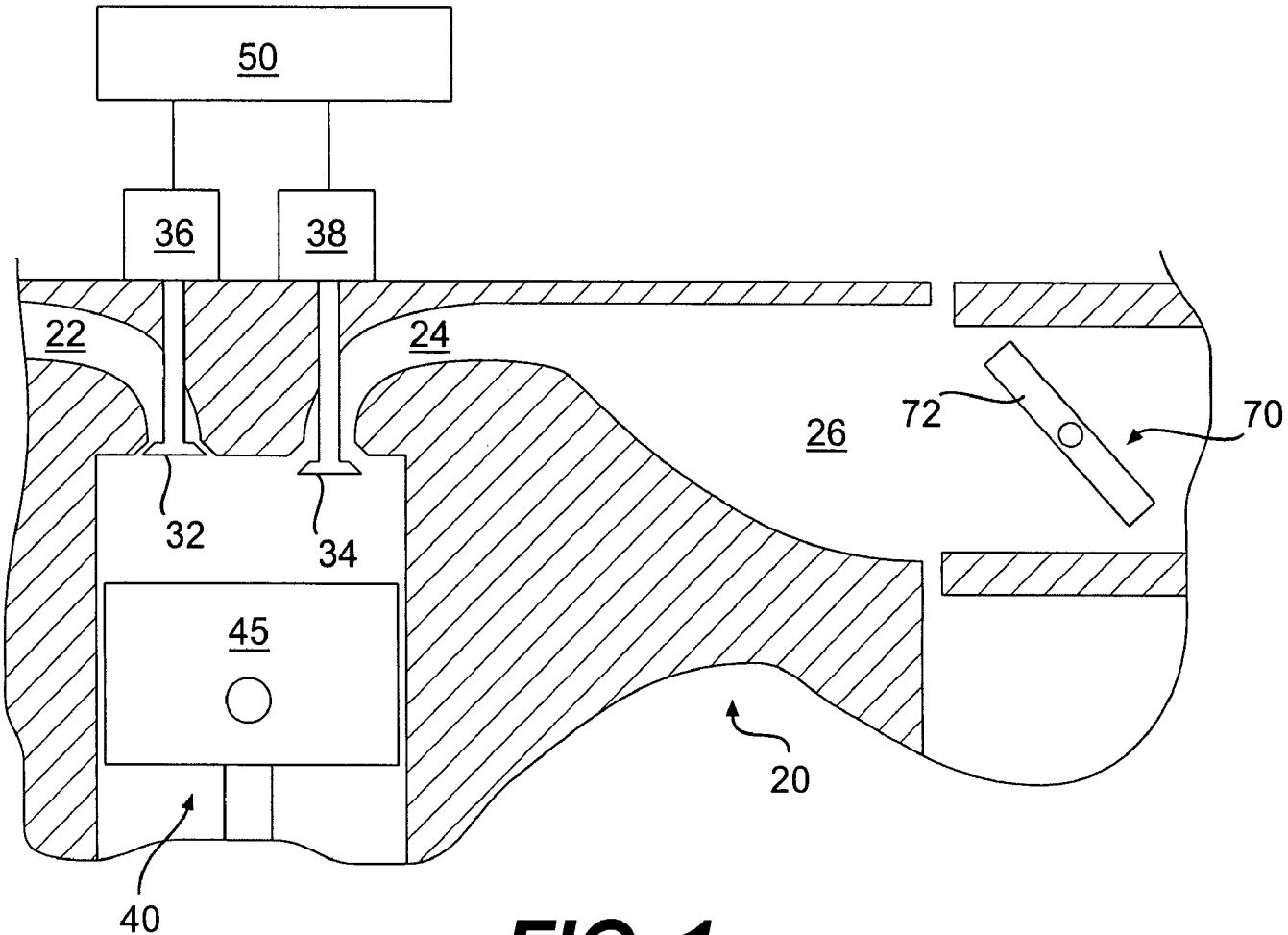
FIG. 1 is schematic diagram of a valve actuation system that may be used to actuate an exhaust or auxiliary engine valve in accordance with embodiments of the present invention.

Reference will now be made in detail to an example of a system that may be used to actuate an exhaust or auxiliary valve in accordance with an embodiment of the present invention. An engine cylinder 40 in a portion of an engine 20 is shown in FIG. 1. The engine 20 may have any number of similar cylinders 40 in which a piston 45 may reciprocate upward and downward repeatedly, during the time the engine is used for positive power and engine braking. At the top of the cylinder 40 there may be at least one intake valve 32 and one exhaust valve 34. It is common for there to be two or more intake valves 32 and exhaust valves 34 each in an engine cylinder, and only one each is shown for ease of illustration. The intake valve 32 and exhaust valve 34 may be opened and closed to provide communication with an intake gas passage 22 and an exhaust gas passage 24, respectively. The exhaust gas passage 24 may communicate with an exhaust manifold 26, which may also have inputs from other exhaust gas passages (not shown) from other engine cylinders. Downstream of the exhaust manifold 26 there may be an exhaust restriction means 70 which may be selectively activated to restrict the flow of exhaust gas from the manifold 26. Exhaust restriction means 70 may be provided by various means, such as a turbocharger turbine, a variable geometry turbocharger, a butterfly valve 72 in the exhaust pipe, shown, or other restriction means. The exhaust restriction means, when closed partially or fully, may selectively develop exhaust back pressure in the exhaust manifold 26 and the exhaust gas passage 24 which may be used for BGR.

The engine 20 may include an exhaust valve actuating subsystem 38 and an intake valve actuating subsystem 36, for actuating the engine valves during positive power and engine braking modes of operation. The engine could optionally include an auxiliary valve and auxiliary valve actuating subsystem (not shown) to provide auxiliary communication between the engine cylinder 40 and the exhaust gas passage 24. There are several known subsystems 36 and 38 that may be used for opening intake and exhaust valves for intake and exhaust events, including, but not limited to mechanical valve trains, electrical actuators, and hydraulic (such as lost motion) actuators. It is contemplated that any such subsystem or combination of subsystems, and/or new subsystems developed by the Applicant or others may be used to provide engine valve actuation for the intake and exhaust valves.

The actuation of the exhaust valve 34 may be controlled by the subsystem 38 to open the exhaust valve for brake gas recirculation and engine braking, such as compression-release braking, bleeder braking, or partial bleeder braking. The exhaust valve actuating subsystem 38 may comprise various hydraulic, hydro-mechanical, and electromagnetic actuation means, including but not limited to means which derive the force to open the valve from a common rail, lost motion, rocker arm, cam, push tube, or other mechanisms. The exhaust valve actuating subsystem 38 and the intake valve actuating subsystem 36 may be electronically controlled by an ECM 50 to vary the valve actuation events that are provided by the exhaust valve 34 and intake valve 32 during positive power and/or engine braking.

During engine braking, the exhaust restriction means 70 may be closed or partially closed to increase exhaust back pressure. Increased back pressure may be used to increase the charge and pressure of gas in the cylinder 40 for braking when increased back pressure is provided in combination with a brake gas recirculation event.

During brake gas recirculation, gas flow may temporarily reverse from the exhaust manifold 26 into the engine cylinder 40 and potentially even back past the intake valve 32 and into the intake passage 22. Control of this backward gas flow through the exhaust and intake valves determines the system exhaust pressure profile and the resulting mass charge that is delivered to the cylinder on intake. The mass charge may affect the power of engine braking because, generally, the greater the pressure of the gas in the cylinder 40, the greater the amount of braking that may be realized from the reciprocating piston 45 as it is opposed by the high pressure gas.

Figure 2:
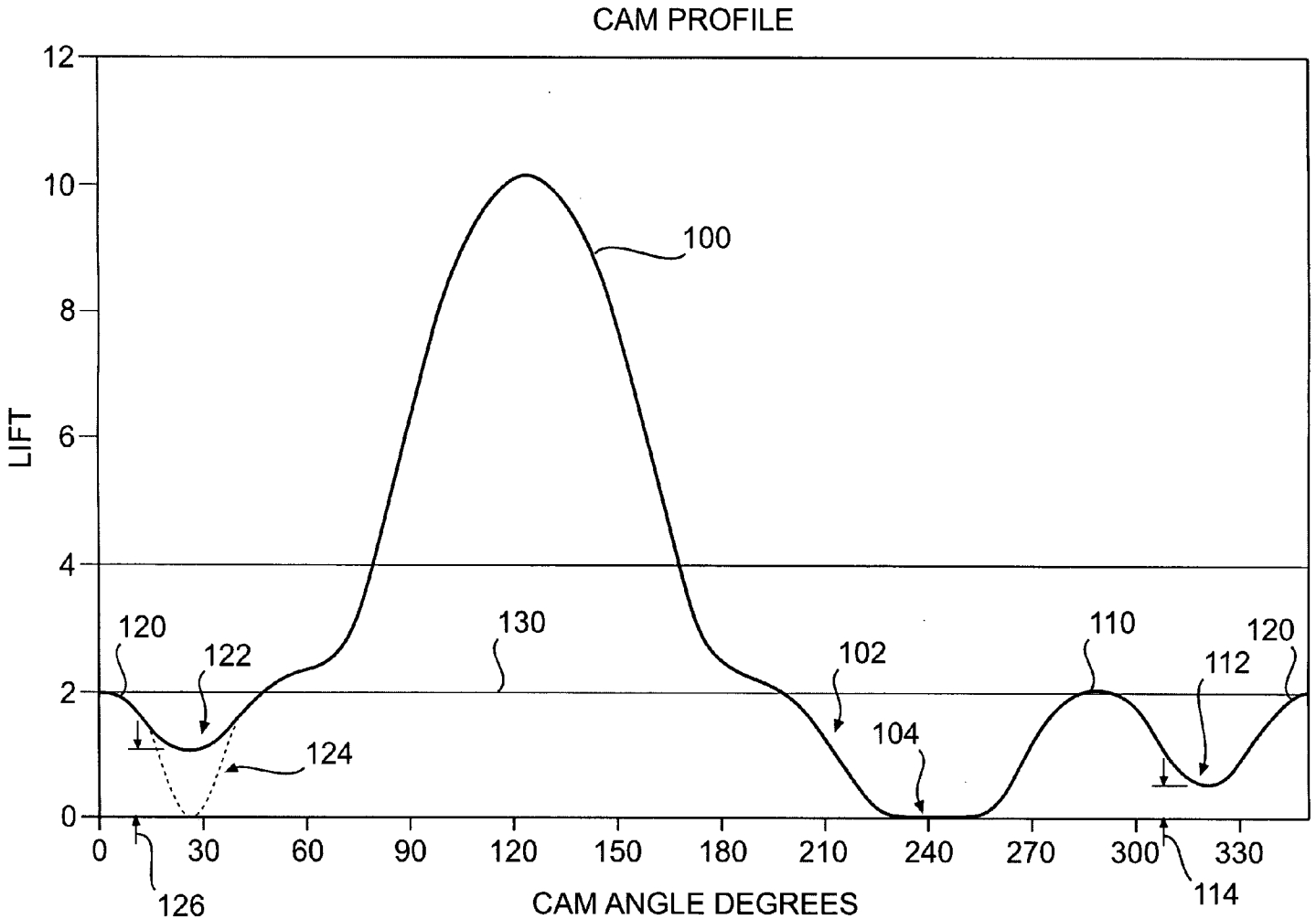
FIG. 2 is a plot of cam follower lift versus cam angle degrees in accordance with an embodiment of the present invention.
Figure 3:
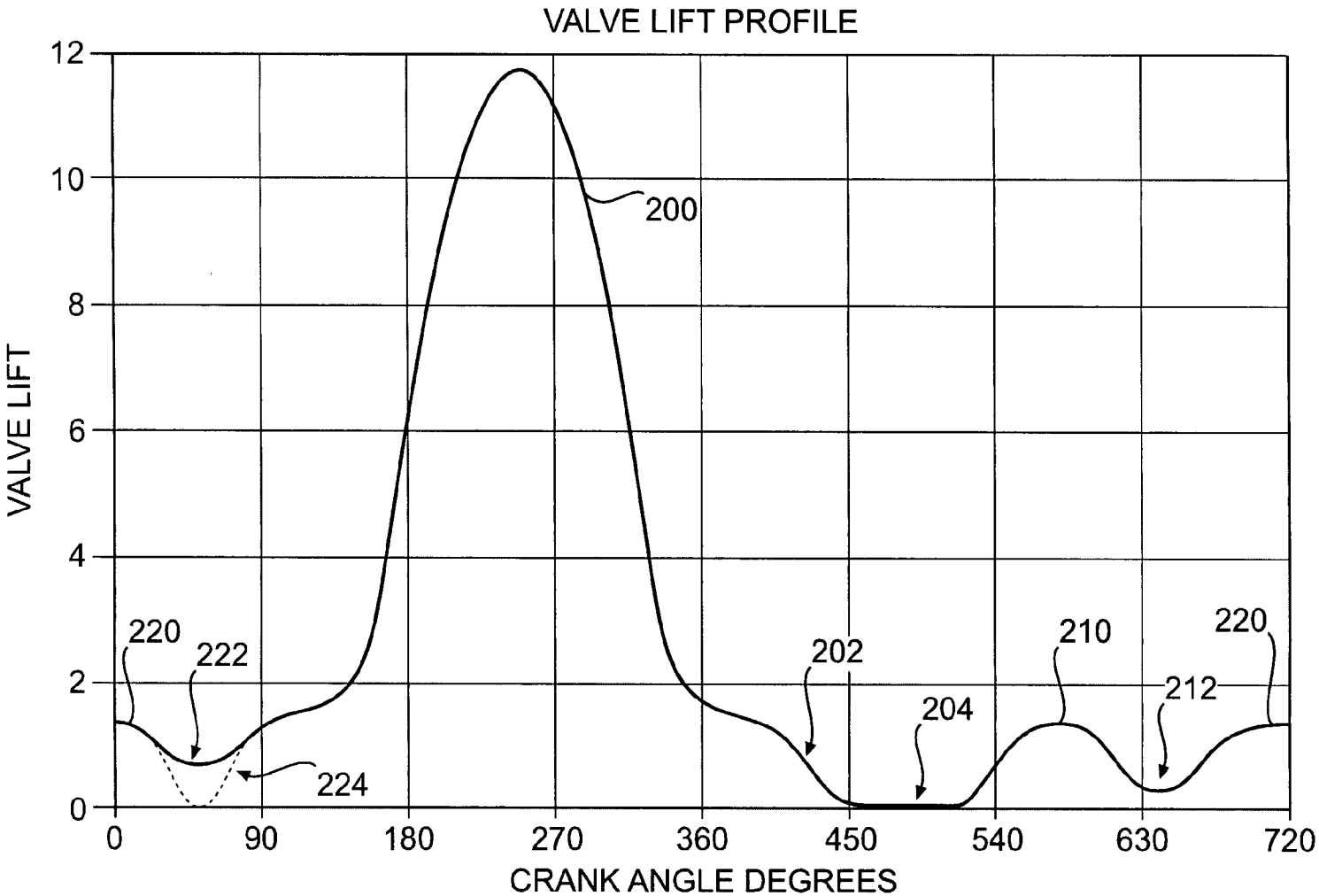
FIG. 3 is a plot of valve lift versus crank angle degrees produced in accordance with an embodiment of the present invention.

FIG. 2 is an example of the cam follower lift that may result from the system shown in FIG. 1 to actuate an exhaust valve to produce engine braking in accordance with an embodiment of the present invention shown in FIG. 3. FIG. 2 is a plot of the cam follower lift produced from a cam having a number of lobes extending from the cam base circle which may be used to provide main exhaust, BGR and compression-release valve events. Cam base circle is indicated by zero (0) lift in FIG. 2. The exhaust cam profile may include a main exhaust lobe 100, a BGR lobe 110 and a compression-release lobe 120.

The cam may be connected to a lost motion system that is inoperative during positive power operation of the engine the cam lobes with a height less than the threshold 130 (which may be the height of the valve or cam lash) are absorbed or "lost". Thus, during positive power operation, cam motion from the BGR lobe 110 and the compression-release lobe 120 is not transferred to the exhaust valve. Only motion from the main exhaust event 100 may be transferred to the exhaust valve during positive power, just as it would be in an engine that did not include an engine brake.

During engine braking, the lost motion system may be turned on and provided with hydraulic fluid so that the motion imparted by the BGR lobe 110 and the compression-release lobe 120 may cease to be "lost," and motion from all cam lobes may be transferred to the exhaust valve. As a result, during engine braking, the cam may impart the following additional motions to the exhaust valve. Region 102 of the cam corresponds to the closing ramp portion of the main exhaust lobe 100 used during engine braking. The closing ramp portion 102 of the main exhaust lobe is shown to return to base circle in region 104 between about 210 and 240 cam angle degrees, or more preferably between about 225 and 235 cam angle degrees.

The BGR lobe 110 may begin after region 104 between about 230 and 270 cam angle degrees, and more preferably between about 240 and 260 cam angle degrees. The BGR lobe 110 may reach a maximum height between about 270 and 300 cam angle degrees and then return toward the cam base circle. Region 112 of the cam corresponds to the intersection of the BGR lobe 110 with the compression-release lobe 120. The lowest point of region 112 may be elevated above the cam base circle a minimum height 114 which is sufficient to keep the exhaust valve from seating (i.e., completely closing) between the BGR event and the compression-release event. The lowest point of region 112 may be between about 300 and 340 cam angle degrees, and more preferably between about 310 and 330 cam angle degrees. The minimum height 114 may be selected such that the exhaust valve is very nearly, but not quite closed between the BGR event and the compression-release event shown in FIG. 3.

The compression-release engine braking lobe 120 may follow the BGR lobe 110. The compression-release lobe 120 may be provided on the cam so as to open the exhaust valve near the point that the engine cylinder piston reaches its top dead center position. The compression-release lobe 120 may reach a maximum height as early as 350 cam angle degrees or after zero cam angle degrees (i.e., by top dead center) and return towards base circle thereafter. Region 122 of the cam corresponds to the intersection of the compression-release lobe 120 with the main exhaust lobe 100. The lowest portion of region 122 may be elevated above the cam base circle by a minimum distance 124 such that the exhaust valve does not close between the compression-release event and the main exhaust event. Alternatively, the lowest portion of the region 122 may return all the way to cam base circle by following alternative cam profile 124.

The cam profile shown in FIG. 2 may provide the exhaust valve actuation shown in FIG. 3 during engine braking operation. A valve lift of zero (0) in FIG. 3 indicates that the exhaust valve is closed and seated. With reference to FIG. 3, the exhaust valve may be actuated for a main exhaust event 200 and seated in accordance with valve seating event 202. The exhaust valve may remain seated during period 204 until it is actuated for a BGR event 210. During the period that the exhaust valve is seated, no exhaust gas exchange may occur between the engine cylinder and the exhaust manifold.

Next, the exhaust valve may be actuated for the BGR event 210. The BGR event may overlap partially or entirely with an intake event. During the BGR event, exhaust gas in the exhaust manifold may flow back into the engine cylinder and potentially back through the open intake valve into the intake manifold. This may result in increased exhaust mass in the cylinder for the subsequent compression-release event. After reaching a maximum lift for the BGR event, the exhaust valve may return towards its seat, but not close at a point 212 between the BGR event 210 and the compression-release event 220. The amount of lift that the exhaust valve maintains at point 212 may vary in different embodiments of the present invention. It may even be zero and thus the exhaust valve may seat between the BGR event and the compression-release event in some embodiments of the present invention with greater compliances, and/or larger valve lash settings.

The compression-release event 220 may follow the BGR event 110. During the compression-release event, the lift of the exhaust valve is increased as the engine cylinder piston approaches and reaches a top dead center position. Gas pressure in the cylinder may be released to the exhaust manifold by increasing the lift of the exhaust valve near the end of the compression stroke of the piston. This compression energy of the exhaust gas in the cylinder may be released to the exhaust manifold instead of doing positive work by pushing the engine piston downward during the expansion stroke. After reaching a maximum lift for the compression-release event 220, the exhaust valve may return towards its seat during period 222 between the compression-release event 220 and the main exhaust event 200. The exhaust valve may maintain some lift and not close during period 222, or alternatively, the exhaust valve may seat in accordance with the valve actuation 224.

Figure 4:
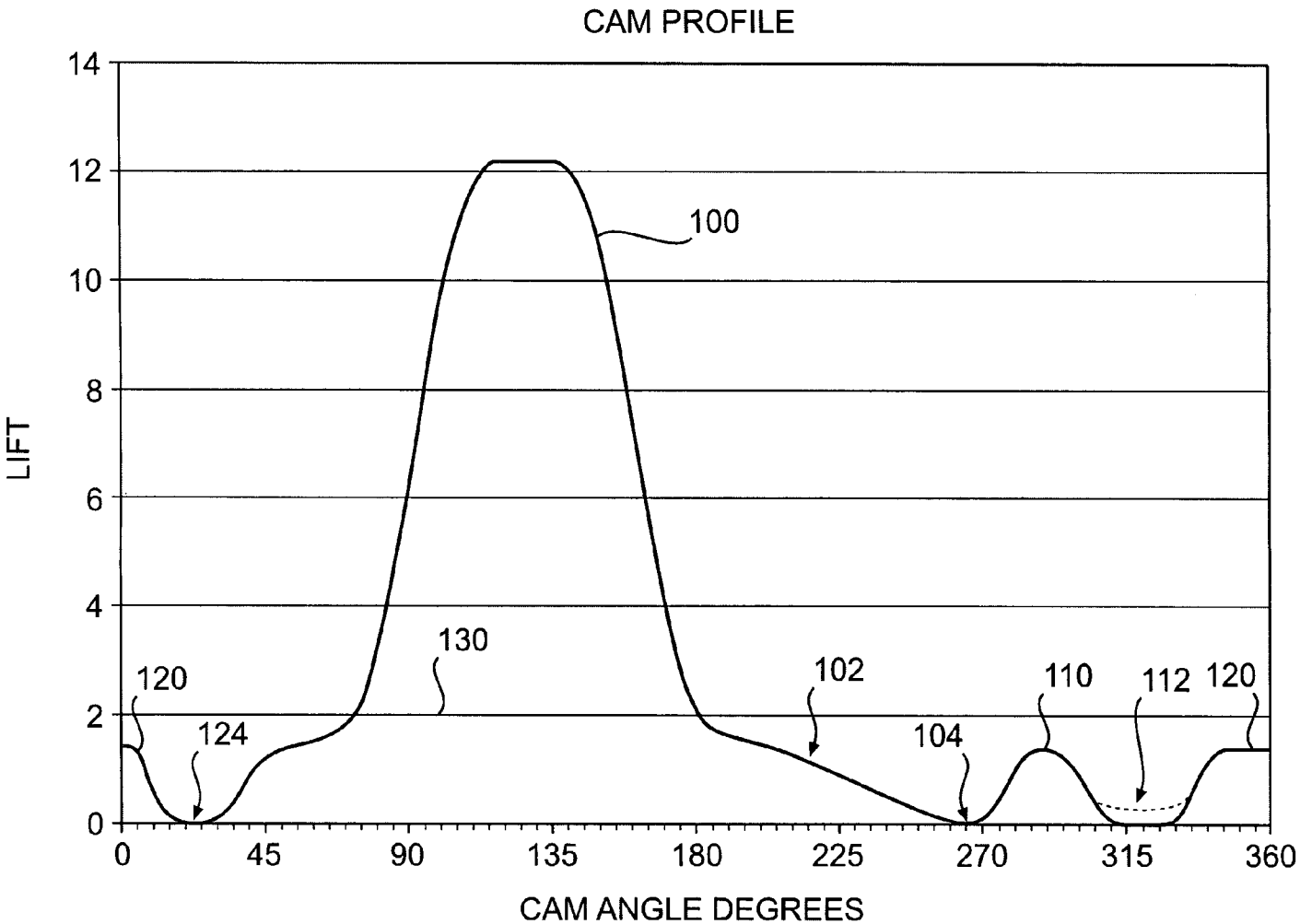
FIG. 4 is a plot of cam follower lift versus cam angle degrees in accordance with an alternative embodiment of the present invention.

An alternative cam follower lift shown in FIG. 4 may include a closing ramp that is better able to draw hydraulic fluid into the lost motion system with a valve lift reset function. The cam follower lift shown in FIG. 4 differs from that shown in FIG. 2 as follows. Region 102 of the cam, corresponding to the closing ramp portion of the main exhaust lobe 100, may be extended from that shown in FIG. 2, all the way or almost all the way to the BGR event 110. The valve closing velocity produced by the region 102 of the main exhaust lobe may be designed to match the hydraulic fluid refill speed to optimize hydraulic refill for a lost motion system with a reset function. The closing ramp portion 102 of the main exhaust lobe is shown to return to base circle in region 104 between about 230 and 265 cam angle degrees.

The BGR lobe may return to base circle such that the exhaust valve closes between the BGR event and the compression-release event. Alternatively, the BGR lobe may approach base circle, but not reach it in region 112 such that the exhaust valve remains open between the BGR event and the compression-release event.

A cam with the extended closing ramp 102 shown in FIG. 4 may be used in a hydraulic valve actuation system that also includes a resetting device, such as disclosed in U.S. Pat. Nos. 5,460,131 to Usko and 4,399,787 to Cavanaugh, for example. The resetting device may cause the exhaust valve to close before the cam follower reaches the cam base circle in region 104. The extended closing ramp 102 may improve the ability of the hydraulic valve actuation system to refill with hydraulic fluid for the next hydraulic valve actuation, namely the BGR event.

While various embodiments of the present invention have been described herein, it is evident that many alternatives, modifications and variations will be apparent to those skilled in the art. Accordingly, the preferred embodiments of the invention as set forth herein we intended to be illustrative, not limiting. Various changes may be made without departing from the spirit and scope of the invention as defined in the following claims.

What is claimed is:

1. A method of actuating an engine valve provided between an engine cylinder and an exhaust manifold to provide compression-release engine braking comprising the steps of:

opening the engine valve for a brake gas recirculation event;

increasing the lift of the engine valve during an initial portion of the brake gas recirculation event;

reducing the lift of the engine valve during a later portion of the brake gas recirculation event;

maintaining the engine valve open between the brake gas recirculation event and a compression-release event; and increasing the lift of the engine valve during an initial portion of the compression-release event.

2. The method of claim 1 further comprising the step of reducing the lift of the engine valve during a later portion of the compression-release event.

3. The method of claim 2 further comprising the step of maintaining the engine valve open between the compression-release event and a main exhaust event.

4. The method of claim 1 further comprising the step of maintaining the engine valve open between the compression-release event and a main exhaust event.

5. The method of claim 1 further comprising the step of closing the engine valve between the compression-release event and a main exhaust event.

6. The method of claim 1 further comprising the step of restricting the flow of exhaust gas out of the exhaust manifold during the compression-release braking.

7. The method of claim 1 wherein the engine valve is an exhaust valve.

8. The method of claim 1 wherein the engine valve is a valve dedicated for engine braking.

9. An internal combustion engine cam for compression-release engine braking comprising:

a main exhaust lobe including an extended closing ramp portion;

a brake gas recirculation lobe;

a compression-release lobe; and a base circle portion extending approximately 15 cam angle degrees or less between the main exhaust lobe extended closing ramp portion and the brake gas recirculation lobe.

10. The cam of claim 9 further comprising a depressed region between the brake gas recirculation lobe and the compression-release lobe, wherein said depressed region has a height greater than the base circle portion of the cam.

11. The cam of claim 10 further comprising a second depressed region between the compression-release lobe and the main exhaust lobe, wherein said second depressed region has a height greater than the base circle portion of the cam.

12. The cam of claim 10 further comprising a second depressed region between the compression-release lobe and the main exhaust lobe, wherein said second depressed region has a height equal to the base circle portion of the cam.

13. The cam of claim 9 further comprising a second depressed region between the compression-release lobe and the main exhaust lobe, wherein said second depressed region has a height greater than the base circle portion of the cam.

14. The cam of claim 9 further comprising a second depressed region between the compression-release lobe and the main exhaust lobe, wherein said second depressed region has a height equal to the base circle portion of the cam.

15. An internal combustion engine cam for compression-release engine braking comprising:

a base circle portion;

a brake gas recirculation lobe;

a compression-release lobe; and a depressed region between the brake gas recirculation lobe and the compression-release lobe, wherein said depressed region has a height greater than the base circle portion of the cam.

16. The cam of claim 15 further comprising a main exhaust lobe.

17. The cam of claim 16 further comprising a second depressed region between the compression-release lobe and the main exhaust lobe, wherein said second depressed region has a height greater than the base circle portion of the cam.

18. The cam of claim 16 further comprising a second depressed region between the compression-release lobe and the main exhaust lobe, wherein said second depressed region has a height equal to the base circle portion of the cam.

* * * * *